United States Patent [19]

Braunstein

[11] Patent Number: 4,938,016

[45] Date of Patent: Jul. 3, 1990

[54] WIRE STRAND FOR ELASTOMER REINFORCEMENT

[75] Inventor: Glenn E. Braunstein, Massillon, Ohio

[73] Assignee: The Goodyear Tire & Rubber Company, Akron, Ohio

[21] Appl. No.: 325,982

[22] Filed: Mar. 20, 1989

[51] Int. Cl.[5] ..... B60C 9/00; D02G 3/48

[52] U.S. Cl. ..... 57/212; 57/213; 57/218; 57/902

[58] Field of Search ..... 57/212, 213, 218, 230, 57/902

[56] References Cited

U.S. PATENT DOCUMENTS

| | | | |
|---|---|---|---|
| 3,538,702 | 11/1970 | Wolf et al. | 57/212 X |
| 4,488,587 | 12/1984 | Umezawa et al. | 57/213 X |
| 4,608,817 | 9/1986 | Brandyberry et al. . | |
| 4,707,975 | 11/1987 | Umezawa . | |
| 4,783,955 | 11/1988 | Uchio | 57/230 X |
| 4,829,760 | 5/1989 | Dambre | 57/212 |

FOREIGN PATENT DOCUMENTS 0290082 11/1988 European Pat. Off. .

*Primary Examiner*—Stuart S. Levy
*Assistant Examiner*—Steven M. DuBois
*Attorney, Agent, or Firm*—T. P. Lewandowski; Robert C. Collins

[57] ABSTRACT

A wire strand for reinforcing elastomers such as tires and conveyor belts comprises multiple individual filaments bundled in a core and an outer layer on a common axis. Each individual filament is tangential to all adjacent surrounding filaments and all filaments have identical lay direction and length in a hexagonally close-packed cross section, which is to say that the strand filaments are of bunched configuration. In accordance with the invention, the outer layer includes filaments of differing diameters so disposed with respect to each other and with respect to the filaments of the core that the outer edges of all filaments in the outer layer, viewed cross sectionally, lie substantially on a common radius from the strand axis.

12 Claims, 1 Drawing Sheet

WIRE STRAND FOR ELASTOMER REINFORCEMENT

Figure 1:
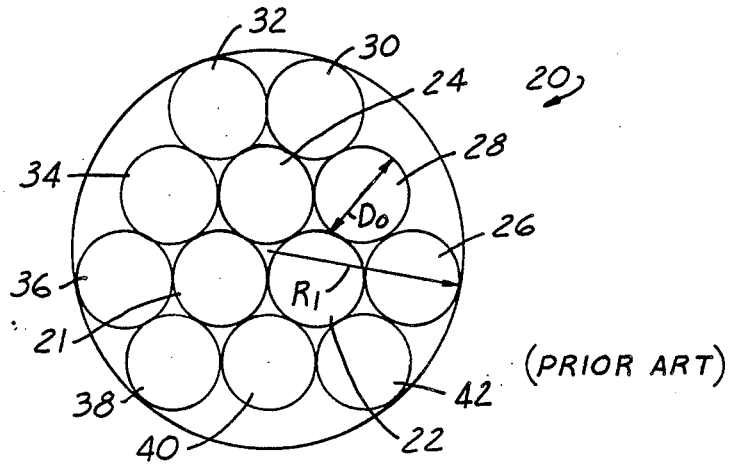

The present invention is directed to wire strands and cords for reinforcement of elastomeric articles such as tires and conveyor belts.

As conventionally employed in the art and in this application, the term "strand" refers to a group of individual "wires" or "filaments" combined to form a unit product. "Stranding" is the laying of several wires helically around a center wire or common axis. The axial distance required for a wire to make a 360° revolution around the center wire or axis is the "length of lay" or "lay length" of the strand. The direction of lay may be either right-hand ("Z") or left-hand ("S"). The term "cord" refers to an end product for reinforcement purposes, and may be composed of a single strand, or of multiple strands "layed" or "cabled" together in either the S or Z direction. A cord having "ordinary lay" is one in which the wires of the individual strands are laid in one direction, and the strands of the cord are laid in the opposite direction. The term "cord" employed in the elastomer-reinforcement art is generally considered to be synonymous with the terms "cable" and "rope" employed for similar structures in other arts.

It is conventional practice to manufacture steel strands, for tire reinforcement and like applications, by laying multiple filaments at a specified lay length. For example, in one conventional manufacturing technique, a twelve-wire strand for reinforcing tires is made by laying nine wires of plated steel helically around a preformed center or core of three wires. The nine outer wires have a lay direction opposite to that of the three-wire core. In a "layered" or "3+9" construction formed in a multiple-step operation of this character, the outer edges of the outer wires contact a circle concentric with the strand. Further, there is separation between the outer wires that permits substantial penetration of rubber between individual wires when calendered into an elastomer for reinforcement, which in turn helps prevent migration of and friction between individual wires.

To eliminate manufacturing steps and associated costs, it has heretofore been proposed to form so-called "bunched" or "compact" wire strands in a single operation in which the filaments are simultaneously laid together in the same direction and lay length. The resulting strand possesses a hexagonally close-packed polygonal cross section that is generally uniform over the length of the strand. The filaments in the strand cross section are arranged in concentric layers in which each individual filament is tangential to all adjacent surrounding filaments. In a "12×" bunched strand construction, for example, twelve filaments of the same diameter are laid simultaneously. The resulting bunched cross section is of hexagonal outline or contour, having relatively sharp corners circumferentially spaced around the strand.

In a typical strand or cord manufacturing process, a single "spiral wrap" wire or filament is applied to the cable in a lay direction opposite to that of the strand or cord. The spiral wrap imparts stiffness to the cord and helps to facilitate factory processing by maintaining the integrity of the cord. Such a spiral wrap impinges upon the six sharp corners in a 12×hexagonal construction, which will ultimately result in fretting of the six "apex" wires. This differs from the 3+9 layered construction where the spiral wrap contacts all nine outer filaments, resulting in more uniform distribution of contact stress.

In addition, when multiple bunched-wire strands are cabled together to form a cord, each strand contacts the surrounding strands at the six relatively sharp corners of the strand outer contour, resulting in fretting and fatigue during use. Further, the filaments of the hexagonal strand cross section are closely bunched, permitting little rubber penetration between individual filaments.

U.S. Pat. No. 4,707,975 discloses a number of single-strand steel cords of bunched configuration in which the outer filament layer includes wires of differing diameter. Specifically, in a "12×" bunched strand configuration disclosed in the noted patent, six filaments of a first diameter are layed with six filaments of a second diameter such that the filaments of lesser diameter are disposed in the outer layer. The ratio of the first diameter to second diameter is in the range of 1.03 to 1.25. However, the strand configurations disclosed in the noted patent retain the polygonal cross sectional configuration characteristic of bunched strands in accordance with the prior art, and thus would exhibit the point-contact and fatigue characteristics as noted above.

It is a general object of the present invention to provide a strand for tire reinforcement and like applications that exhibits desirable operating features and properties of layered strand configurations while maintaining the desirable manufacturing economy of bunched configurations of similar size. More specifically, it is an object of the present invention to provide a wire strand of bunched configuration that is of substantially round cross section and that permits enhanced penetration of rubber between individual filaments when molded into an elastomer for reinforcement purposes.

A wire strand for reinforcing elastomers such as tires and conveyor belts comprises multiple individual filaments bunched in a core and an outer layer on a common axis. Each individual filament is tangential to all immediately adjacent surrounding filaments, and all filaments have identical lay direction and length. The strand possesses a hexagonally closepacked polygonal cross sectional outline that is generally uniform lengthwise of the strand, all of which is to say that the strand filaments are of bunched configuration. In accordance with the invention, the outer layer includes filaments of differing diameters so disposed with respect to each other and with respect to the filaments of the core that the outer edges of all filaments in the outer layer lie substantially on a common radius from the strand axis, which is to say that the surfaces of all outer filaments are tangential to a common outer radius.

In a preferred ×12×" bunched wire strand construction in accordance with the present invention, the filaments are disposed in a 6+6 configuration that includes six filaments of a first diameter D1 and six filaments of a second diameter D2 less than the first diameter. Three filaments of diameter D1 comprise a substantially triangular core, and the outer layer includes three filaments of diameter D1 respectively positioned between and contiguous with adjacent pairs of core filaments, and six filaments of diameter D2 respectively positioned between and contiguous with one filament of diameter D1 in the core and one filament of diameter D1 in the outer layer. The diameters D1 and D2 are preferably in the range of about 0.12 to 0.40 mm, and diameter D1 is preferably substantially equal to 1.6 times diameter D2. In one embodiment of the invention, diameter D1 is substantially equal to 0.24 mm, and diameter D2 is substantially equal to 0.15 mm.

Figure 2:
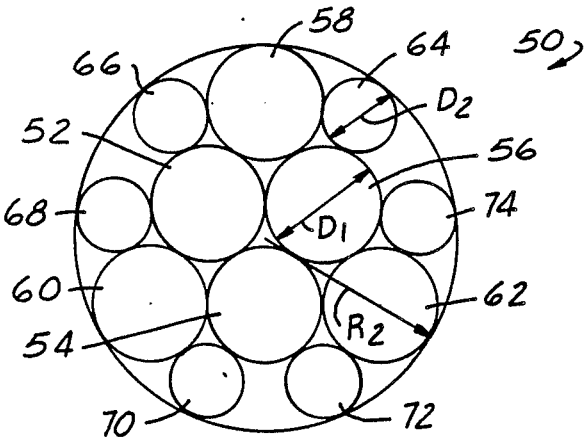

The invention, together with additional objects, features and advantages thereof, will be best understood from the following description, the appended claims and the accompanying drawing in which:

FIG. 1 is a schematic cross sectional diagram of a wire strand construction in accordance with the prior art; and FIG. 2 is a schematic cross sectional diagram of a comparable wire strand in accordance with a presently preferred embodiment of the invention.

FIG. 1 illustrates a "12×" strand 20 of so-called compact or bunched construction. Strand 20 includes a core of three filaments 21, 22, 24 surrounded by an outer layer of nine filaments 26–42. Filaments 21–42 are of identical diameter, and identical lay direction and length. Thus, as is characteristic with bunched strand constructions, the several filaments 21–42 are tangential to all adjacent surrounding filaments. It will be noted that the outer layer of filaments 26–42 is of hexagonal outline or contour, with filaments 26, 30, 32, 36, 38 and 42 presenting relatively sharp cross sectional corners at the common outer radius R1 from the axis of strand 20. On the other hand, filaments 28, 34 and 40 of the outer layer are spaced radially inwardly from radius R1.

FIG. 2 illustrates the cross section of a strand 50 in accordance with a presently preferred "12×" embodiment of the invention as comprising a triangular core of three filaments 52, 54, 56 of identical diameter D1, and an outer layer of three filaments 58, 60 and 62 of diameter D1 positioned between and adjacent to (i.e.—substantially contiguous with or contacting) pairs of filaments of the inner core, and six filaments 64–74 of diameter D2 less than diameter D1. Each filament 64–74 is positioned so as to be circumferentially adjacent to (i.e.—substantially contiguous with) one filament of diameter D1 in the core and one filament of diameter D1 in the outer layer. In accordance with the distinguishing feature of the present invention, diameters D1, D2 are so related to each other that the outer edges of all filaments 58–64 in the outer strand layer lie on a common radius R2 from the axis of strand 50. Stated differently, the surfaces of all filaments 58–64 in the outer layer intersect and are tangential to the common outer radius R2. Thus, strand 50 is of essentially or quasi circular cross sectional construction.

In preferred embodiments of the invention, both diameters D1, D2 are in the range of 0.12 to 0.40 mm. To obtain the quasi-round cross section employing wires of two differing diameters, the ratio of diameter D1 to diameter D2 is substantially equal to 1.6. In one presently preferred embodiment of the invention, diameter D1 is substantially equal to 0.24 mm, and diameter D2 is substantially equal to 0.15 mm.

Wire reinforcement strands in accordance with the present invention thus retain the manufacturing economy inherent with bunched or compact construction techniques as hereinabove described, and in addition possess a number of significant advantages over conventional bunched constructions. For example, circumferential separation between adjacent filaments of diameter D2 illustrated in FIG. 2 permits enhanced rubber penetration between the filaments. Indeed, all filaments 52–74 in construction 50 would be in contact with rubber compound following a calendering operation, greatly reducing or eliminating filament migration during repetitive bending as in tire applications. Strand construction 50 in accordance with the invention is essentially a round construction. When strand 50 is cabled with other strands to form a multiple-strand reinforcement cord, more uniform distribution of contract stress is obtained between the filaments of adjacent strands. Such constructions therefore obtain improved dynamic properties. There is improved adhesion among the cabled strands due to increased rubber penetration into each strand. When a spiral wrap is applied to strand 50 in an opposite lay direction as is conventional, the spiral wrap will contact all outer filaments, resulting in a more even distribution of contact stresses.

For strands 20, 50 of equal effective diameter—i.e., with R1 and R2 equal—strand 50 in accordance with the invention possesses a higher breaking strength. In addition, for multiple-strand cords of equal diameter, cords having strands 50 of cross sectional configuration illustrated in FIG. 2 possess higher breaking strength than do cords formed of prior art strands 20 illustrated in FIG. 1.

The invention claimed is:

1. A wire strand for reinforcing elastomers and the like that comprises multiple individual filaments having identical lay direction and length, said filaments being disposed in a core and an outer layer around a common axis in a hexagonally close-packed longitudinally uniform cross sectional outline with each individual filament being tangential to all adjacent surrounding filaments; said core comprising a first number of filaments of a first diameter, and said outer layer comprising a second number of filaments of said first diameter respectively positioned between and adjacent to two filaments of said core, and a third number of filaments of a second diameter respectively positioned between and adjacent to one filament of said first diameter in said core and one filament of said first diameter in said outer layer; said outer layer filaments being so disposed with respect to each other and with respect to filaments of said core that outer edges of all filaments of said outer layer lie substantially on a common radius from said axis.

2. The strand set forth in claim 1 consisting of twelve said wire filaments composed of six filaments of said first diameter (D1) and six filaments of said second diameter (D2) less than said first diameter, said first and second numbers being three and said third number being six.

3. The strand set forth in claim 2 wherein both said diameters D1 and D2 are the range of about 0.12 to 0.40 mm.

4. The strand set forth in claim 3 wherein said diameter D1 is substantially equal to 1.6 times said diameter D2.

5. The strand set forth in claim 4 wherein said diameter D1 is substantially equal to 0.24 mm, and wherein said diameter D2 is substantially equal to 0.15 mm.

6. The strand set forth in claim 1 wherein said first diameter is equal to substantially 1.6 times said second diameter.

7. The strand set forth in claim 6 wherein said first and second diameters are both in the range of about 0.12 to 0.40 mm.

8. The strand set forth in claim 7 wherein said core comprises three filaments of said first diameter; and wherein said outer layer comprises three filaments of said first diameter respectively positioned between and adjacent to two filaments of said core, and six filaments of said second diameter respectively positioned between and adjacent to one filament of said first diameter in said core and one filament of said first diameter in said outer layer.

9. The strand set forth in claim 8 wherein said first diameter is substantially equal to 0.24 mm, and wherein said second diameter is substantially equal to 0.15 mm.

10. The strand set forth in claim 1 wherein said core comprises three filaments of a first diameter; and wherein said outer layer comprises three filaments of said first diameter respectively positioned between and adjacent to two filaments of said core, and six filaments of a second diameter respectively positioned between and adjacent to one filament of said first diameter in said core and one filament of said first diameter in said outer layer.

11. The strand set forth in claim 10 wherein said first diameter is equal to substantially 1.6 times said second diameter.

12. A wire strand for reinforcing elastomers comprising:

twelve filaments of identical lay direction and lay length disposed in a triangular core of three filaments and an outer layer of nine filaments, said twelve filaments including six filaments of diameter substantially equal to 0.24 mm of which three filaments compose said core and three filaments are disposed in said outer layer respectively between and substantially adjacent to two filaments of the core, and six filaments of a diameter substantially equal to 0.15 mm positioned in said outer layer respectively between and substantially adjacent to one filament of said core and one filament of diameter 0.24 mm in said outer layer.

* * * * *